US005607332A

United States Patent [19]

Kobayashi et al.

[11] Patent Number: 5,607,332

[45] Date of Patent: Mar. 4, 1997

[54] CONTROL FOR JET POWERED WATERCRAFT

[75] Inventors: Noboru Kobayashi; Tomoyoshi Koyanagi, both of Iwata, Japan

[73] Assignee: Yamaha Hatsudoki Kabushiki Kaisha, Iwata, Japan

[21] Appl. No.: 363,364

[22] Filed: Dec. 23, 1994

Related U.S. Application Data

[63] Continuation-in-part of Ser. No. 261,761, Jun. 17, 1994, Pat. No. 5,494,464, which is a continuation of Ser. No. 977,127, Nov. 16, 1992, abandoned.

[30] Foreign Application Priority Data

May 29, 1991 [JP] Japan ..... 3-125817
Dec. 27, 1993 [JP] Japan ..... 5-333428

[51] Int. Cl.[6] ..... B63H 11/11

[52] U.S. Cl. ..... 440/41; 114/270

[58] Field of Search ..... 114/270; 440/38, 440/41, 42

[56] References Cited

U.S. PATENT DOCUMENTS 5,062,815 11/1991 Kobayashi ..... 440/41
5,154,650 10/1992 Nakase ..... 440/41

FOREIGN PATENT DOCUMENTS 4151396 5/1992 Japan ..... 440/41

*Primary Examiner*—Jesus D. Sotelo
*Attorney, Agent, or Firm*—Knobbe, Martens, Olson & Bear

[57] ABSTRACT

A number of embodiments of jet propelled watercraft having an improved pedal operated reverse thrust bucket mechanism. The pedal for operating the reverse thrust bucket is positioned so that it is generally flush with the floor area when the reverse thrust bucket is in its forward drive mode and can be depressed into a recessed area of the floor area for effecting trim or reverse thrust operation of the reverse thrust bucket. In this way, the pedal does not obscure the rider's foot area but is still readily accessible for the rider.

20 Claims, 5 Drawing Sheets

CONTROL FOR JET POWERED WATERCRAFT

CROSS-REFERENCE TO RELATED APPLICATION

This application is a continuation-in-part of my application of the same title, Ser. No. 08/261,761, filed Jun. 17, 1994, now U.S. Pat. No. 5,494,464 which application is a continuation of my earlier application of the same title, Ser. No. 07/977,127, filed Nov. 16, 1992, now abandoned, which applications are assigned to the assignee hereof.

BACKGROUND OF THE INVENTION

This invention relates to a control for a watercraft and more particularly to a foot operated control for a watercraft.

As disclosed in my aforenoted co-pending applications, there are a number of advantages in jet propelled watercraft for providing for foot operation of the reverse thrust bucket. This may be done not only to accommodate operation in reverse direction, but also to provide a retardation force when traveling forwardly. In addition, the operator may alter the trim of the watercraft by partially actuating the reverse thrust bucket from its forward drive position toward a rearward drive position. As the reverse thrust bucket occludes part of the discharge nozzle, a force is encountered that will affect the trim of the watercraft.

By providing a pedal control for the reverse thrust bucket, the operator may operate it without having to remove his hands from the steering mechanism of the watercraft. This affords not only safety but also facilities the operation of several controls at the same time.

Where a pedal operator is employed, however, certain types of watercraft have a floor area that is not particularly conducive for pedal control. For example, the seating positions in some watercraft are such that the foot area where the pedal is positioned can provide an awkward seating position for the rider if the rider does not wish to operate the pedal, but also wants to place his foot in such an area where the pedal is located. In addition, pedals that are supported so that they extend above the floor area, as is typical, can be inadvertently actuated.

It is, therefore, a principal object of this invention to provide an improved pedal operated mechanism for a watercraft.

It is a further object of this invention to provide a pedal control for a watercraft wherein the pedal is recessed into the floor area so that it cannot be inadvertently operated and also so the operator may place his foot over the pedal without depressing the pedal.

SUMMARY OF THE INVENTION

This invention relates to a watercraft propulsion control for a watercraft having a hull defining an operator's area in which an operator is seated and a floor area in which the operator may place at least one of his feet. The watercraft hull mounts a propulsion unit for propelling the hull and having at least one control element. The floor area is formed with a recessed portion disposed below a surrounding surface area. A pedal is pivotally supported within the recessed portion and is operatively connected to the control element for foot operation of the control element.

DETAILED DESCRIPTION OF THE PREFERRED EMBODIMENTS OF THE INVENTION

Figure 1:
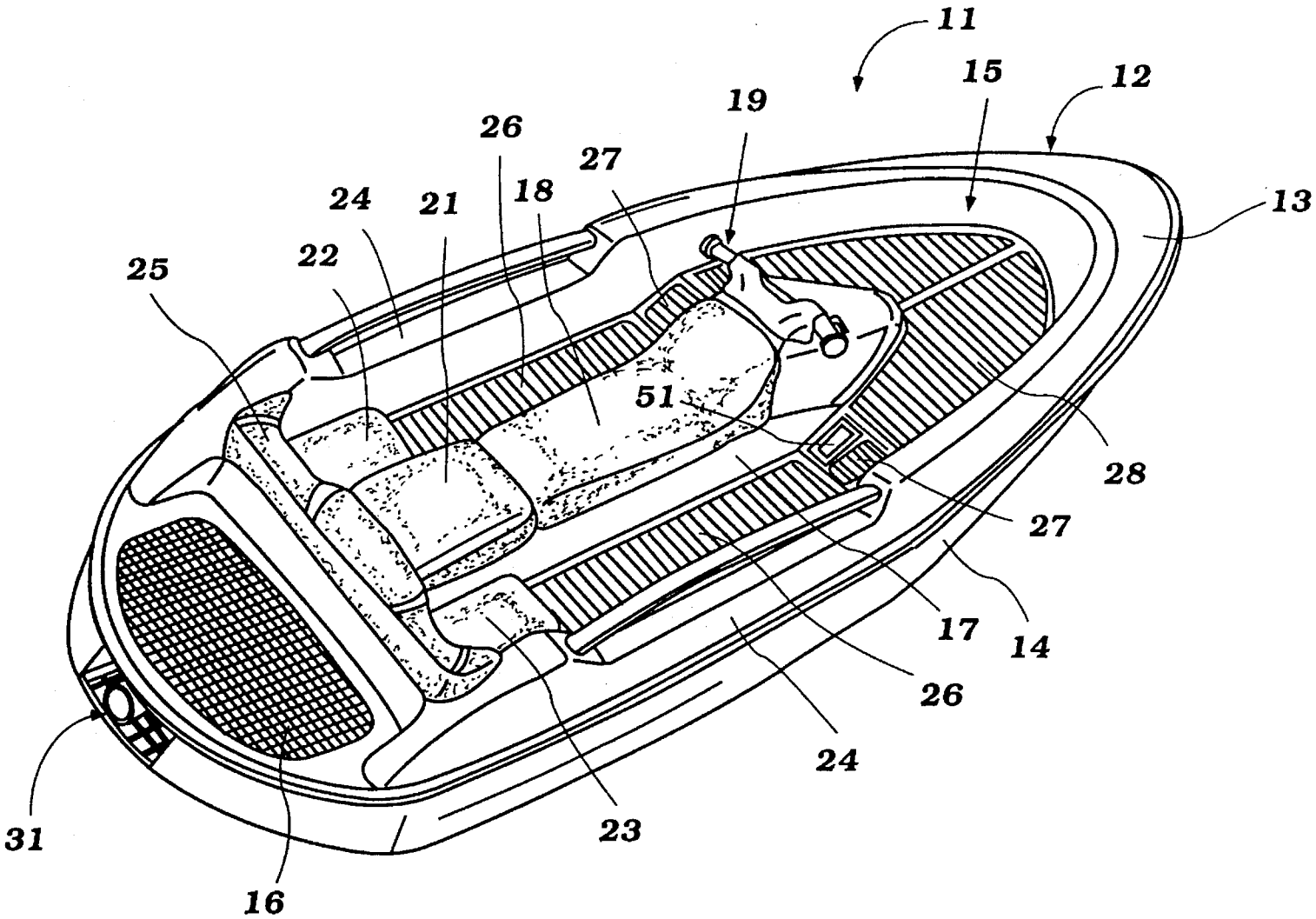
FIG. 1 is a perspective view taken from the rear end and upper side showing the operator's compartment of a watercraft constructed in accordance with an embodiment of the invention.

Referring now in detail to the drawings and initially to FIG. 1, a watercraft embodying this invention is identified generally by the reference numeral 11. The watercraft 11 is of the small personal type. It will be understood, however, that certain facets of the invention may be employed with other types of watercraft. Also, it is to be understood that the configuration of the watercraft 11 as illustrated and described, is only typical of many types of watercraft with which the invention may be practiced.

The watercraft 11 is comprised of a hull, indicated generally by the reference numeral 12 which is formed from any suitable materials such as a molded fiberglass resin or the like, and which has an upper deck portion 13 and a lower hull portion 14, that are affixed to each other in any suitable manner.

A passenger's area 15 is formed in the deck portion 13 and extends from the forward portion of the bow rearwardly and terminates forwardly of a rear deck platform 16. The rear deck platform 16 can accommodate either a standing rider or affords a way in which the watercraft 11 may be boarded from the body of water in which the watercraft is operating. This type of personal watercraft is, as is well known, designed primarily to be operated by riders in swimming suits and it is expected that those riders will enter and exit the body of water in which the watercraft 11 is operating.

Extending longitudinally through the center of the rider's area 15 from its rear end towards its front end, is a raised portion 17 that is adapted to overlie at least in part a tunnel formed at the rear end of the hull portion 14 and an engine compartment position forwardly thereof. As will become apparent by description to FIG. 2, a propulsion unit such as a water jet propulsion unit is positioned in the tunnel and this is driven by an engine positioned in the engine compartment.

The rear portion of the raised area 17 accommodates a longitudinally extending seat 18 that is designed to accommodate one or more riders seated in straddle fashion. If more than one rider is accommodated on the seat 18, they are seated in tandem fashion. Forwardly of the seat 18 is a handlebar assembly 19 that is supported on a further elevated part of the raised portion 17 and which is coupled to certain components of the propulsion unit for its control, as will become apparent.

The seat 18 terminates at its rear end in a further raised portion 21 which may accommodate a third or the second rider. Since the portion 21 is elevated slightly relative to the portion 18, this third rider can see over the heads of those positioned in front of him.

On opposite sides of the seat portion 21 there are provided a pair of rear seats 22 and 23 which extend between raised gunnels 24 formed at the outer side of the hull 12 and the raised central portion 17. A seat back 25 is provided for the seat portions 21, 22 and 23.

The rider's area 15 also includes a foot area to accommodate the feet of the rider seated on the seats 18, 21, 22 and 24. This foot area comprises a pair of longitudinally extending foot portions 26 that extend forwardly from the rear seats 22 and 23 and along the sides of the raised portion 17 between the gunnels 24. The forward part of these foot areas terminate in angularly upwardly inclined toe areas 27. The toe areas 27 merge into a slightly elevated floor area or deck 28 that is disposed around the front part of the raised portion 17 and on which riders may sit or lie.

Figure 2:
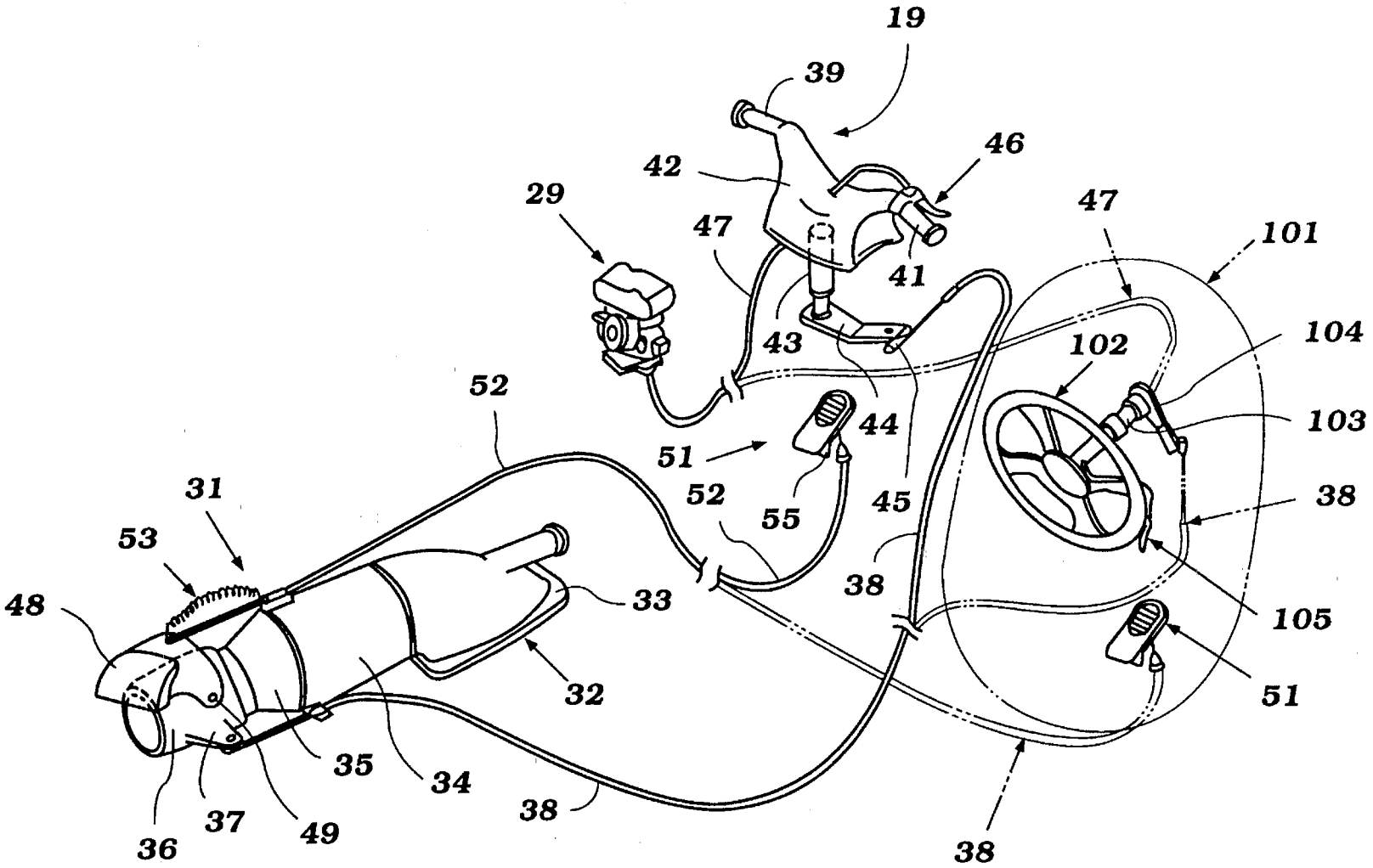
FIG. 2 is a view looking in the same direction as FIG. 1, but shows only the controls for the propulsion unit of a first type in solid lines and of a second type in the encircled phantom line view.

The propulsion and control system for the watercraft 11 will now be described by particular reference to FIG. 2. FIG. 2 is a view looking basically in the same direction as FIG. 1, but the hull is removed so as to more clearly show the internal construction.

An internal combustion engine, shown schematically and indicated generally by the reference numeral 29, is positioned in the aforenoted engine compartment. This can be either forwardly and beneath the deck portion 28, beneath the front part of the raised area 17, or beneath the seat 18. The engine 29 may be of any known type and drives a water jet propulsion unit, indicated generally by the reference numeral 31, and which is positioned, as aforenoted, in a tunnel disposed on the underside of the hull portion 14 and extending generally in a longitudinal direction thereunder along the longitudinal center line.

The jet propulsion unit is comprised of an outer housing that includes a water inlet portion 32 that has an outstanding flange 33 that extends around a downwardly facing water inlet opening which does not appear in FIG. 2, but which is well known in the art. Water is drawn through this inlet opening through the inlet portion 32 by an impeller contained within an impeller housing portion 34 of the jet propulsion unit 31. This water is then discharged in a rearward direction through a discharge nozzle 35. The discharge nozzle 35 has mounted on it a steering nozzle 36 which is pivotally supported on the discharge nozzle 35 in a manner well known in this art for steering movement about a vertically extending steering axis. A control lever 37 formed integrally on the steering nozzle 36 and is connected to one end of the wire actuator of a bowden wire mechanism, indicated by the reference numeral 38.

The handlebar assembly 19 includes a pair of handle grips 39 and 41 which are carried by a main portion 42 from which a steering shaft 43 depends. The steering shaft 43 is suitably journaled in the raised portion 17 of the deck 13. A steering arm 44 is connected to the lower end of the steering shaft 43 and the end of the wire actuator opposite the steering nozzle lever 37 is connected thereto by means of a fastener 45. As a result of this construction, when the handlebar assembly 19 is rotated along with the steering shaft 43, the steering nozzle 36 will be rotated about its vertically extending pivot axis for steering the watercraft in a manner well known in this art.

A lever-type throttle assembly 46 is carried by the handlebar assembly adjacent the handgrip 41. This throttle assembly is connected by means of a bowden wire actuator 47 to the throttle control of the engine 29 for controlling its speed in a manner also well known in this art.

A reverse thrust bucket 48 is pivotally supported on the steering nozzle 36 for pivotal movement about a generally horizontally extending axis by means of a pair of pivot pins 49. By pivoting the reverse thrust bucket 48 from the position shown in FIG. 2 in a downward direction, it is possible to change the trim angle of the watercraft and also when the reverse thrust bucket 48 is in its fully down position, the water discharged from the discharge nozzle 35 will be redirected in a forward direction so as to provide a reverse thrust for the watercraft. Movement into this position may also be employed for retarding the forward speed of the watercraft 11.

A reverse thrust bucket control pedal, indicated generally by the reference number 51, is connected by means of a bowden wire cable 52 into the reverse thrust bucket 48 for moving it between its positions. A coil tension spring 53 is interconnected between the impeller housing 34 and the reverse thrust bucket 48 for normally urging the reverse thrust bucket 48 to its forward drive position and for urging the pedal assembly 51 to its normal returned position.

Figure 3:
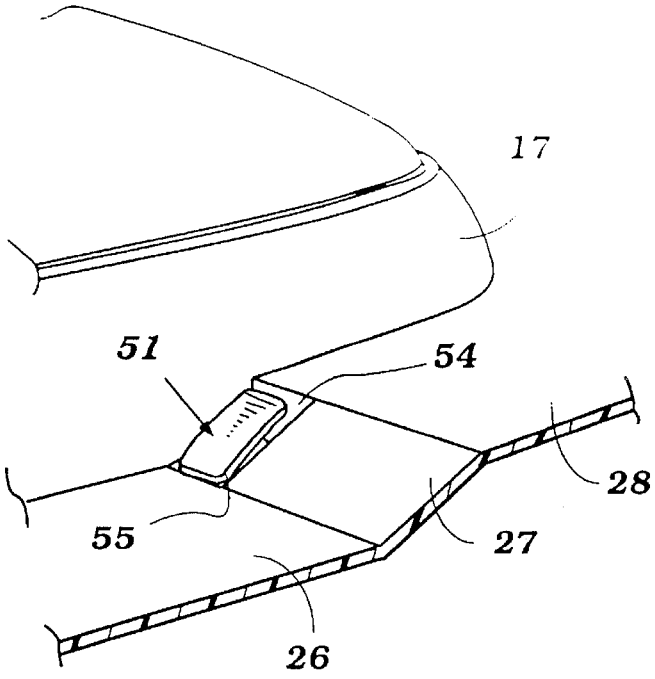
FIG. 3 is an enlarged perspective view of the area where the foot pedal control for the propulsion unit is located in this embodiment.

As may be seen in FIGS. 1 and 3, the floor area of the passenger's compartment and specifically the portion of the toe board 27 on one side of the raised portion 17 is formed with a recess 54. The pedal assembly 51 is mounted in this recess and is pivotally supported at the base of the recess, in this embodiment, by a pivot pin 55 that is fixed suitably to the hull.

When the reverse thrust bucket 48 is in its forward drive position, the pedal 51 is either flush with or slightly below the toe area 24. This insures that the operator may rest his foot close to the raised area 17 without actuating the pedal 51 and moving the position of the reverse thrust bucket 48. However, the operator may easily depress the pedal 51 so as to adjust either the trim of the watercraft 11 or, if fully depressed, move the reverse thrust bucket 48 to its reverse thrust position for retarding the forward motion of the watercraft and/or for propelling the watercraft 11 in a rearward direction. Hence, the pedal 51 is positioned where it is not inadvertently actuated and where it will not interfere with the movement of the rider's feet. However, the pedal 51 may be easily activated when the operator so desires.

Although the control as thus far described has been employed in connection with a handlebar assembly, it may also be employed in conjunction with a steering wheel, as shown in the alternate construction in FIG. 2 in the area encompassed by the phantom line circle 101. In this embodiment, a steering wheel 102 is mounted on a steering shaft 103 which, in turn, is journaled suitably in the raised deck portion 17. A steering lever 104 is connected to the end of the steering shaft 103 and is connected to the bowden wire cable 38 for operating the steering nozzle 36 in the manner aforedescribed.

A throttle control lever 105 is mounted on the steering wheel 102 and rotates with it. The bowden wire cable 47 for the throttle control passes through a hollow center of the steering shaft 103 and terminates at the throttle control lever 105 so that the speed of the engine 29 can be controlled.

Figure 4:
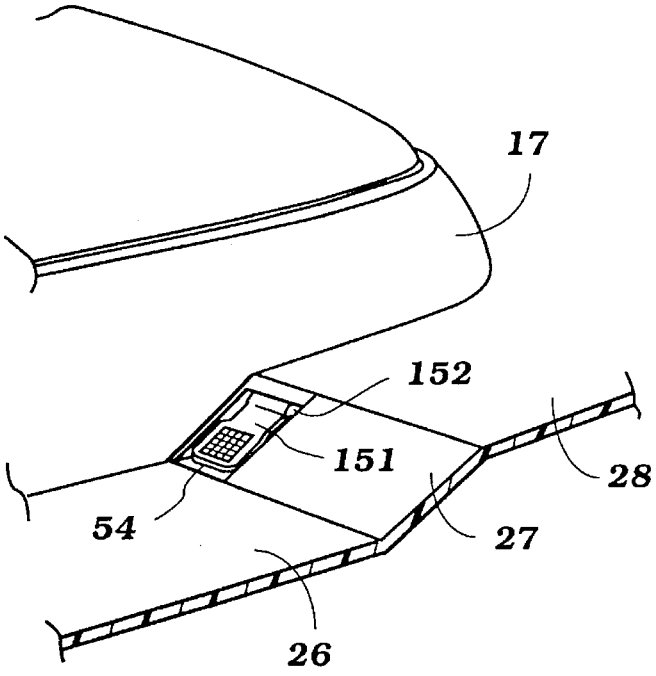
FIG. 4 is an enlarged perspective view, in part similar to FIG. 3 and shows another embodiment.

FIG. 4 shows another embodiment of the invention, and this embodiment differs from the embodiment shown primarily in FIG. 3 only in the way in which the pedal assembly is supported. For that reason, components of this embodiment which are the same as those previously described have been identified by the same reference numerals and will not be described again, except insofar as is necessary to understand the construction and operation of this embodiment.

In this embodiment, a pedal assembly 151 is pivotally supported at the top of the recess 54 on a pivot pin 152 that is mounted in the hull and spans the recess 54. Hence, this pedal 151 is of the suspended type, but it is also connected to the reverse thrust bucket 48 through a bowden wire cable in the manner as previously described. Again, the pedal 151 is disposed so that it is no higher than the level of the toe board 27 when the reverse thrust bucket 48 is in its forward drive condition so that it cannot be accidentally activated. In addition, the operator may place his foot over this area without necessarily depressing the pedal 151 to change the trim or effect retardation or reverse thrust.

Figure 5:
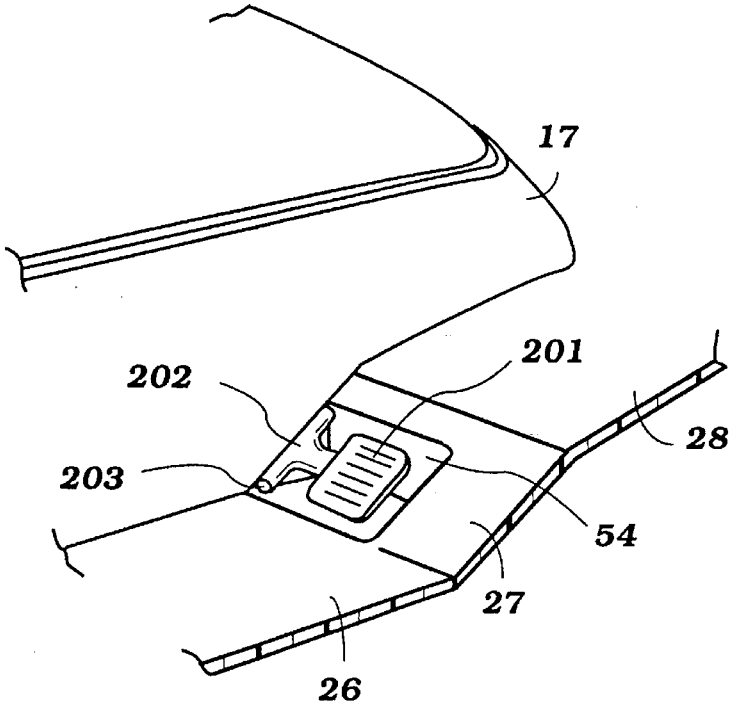
FIG. 5 is an enlarged perspective view showing a further embodiment of the invention.

FIG. 5 shows another embodiment of the invention which is basically the same as the embodiments previously described, except for the way in which the reverse thrust bucket control pedal is mounted in the recess 54. For this same reason, only the differences between this embodiment and the previously described embodiments will be detailed. Components that are the same have been identified by the same reference numerals.

The pedal 201 in this embodiment has a pivot portion 202 that extends along an axis that is parallel to but spaced inwardly from the toe surface 27. A pivot pin 203 is affixed to the hull on the side adjacent the raised portion 17 so that the pedal 201 will pivot about this axis to operate the reverse thrust bucket.

Figure 6:
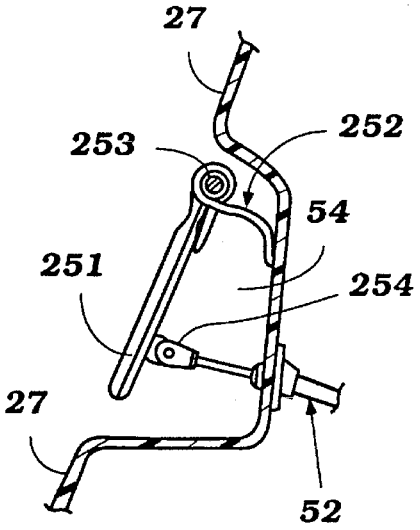
FIG. 6 is a cross-sectional view taken through a pedal assembly constructed in accordance with a fourth embodiment of the invention.

FIG. 6 shows another embodiment of the invention and how the actual pedal, indicated by the reference numeral 251 in this embodiment, is pivotally supported within the recess 54. A bracket 252 is affixed to the hull in the recess area 54 and carries a pivot pin 253. This pivot pin 253 is pivotally connected to the upper end of the pedal 251 so that the pedal 251 can pivot about this axis. The pedal 251 is connected to the bowden wire actuator 52 by means of a connector 254.

Figure 7:
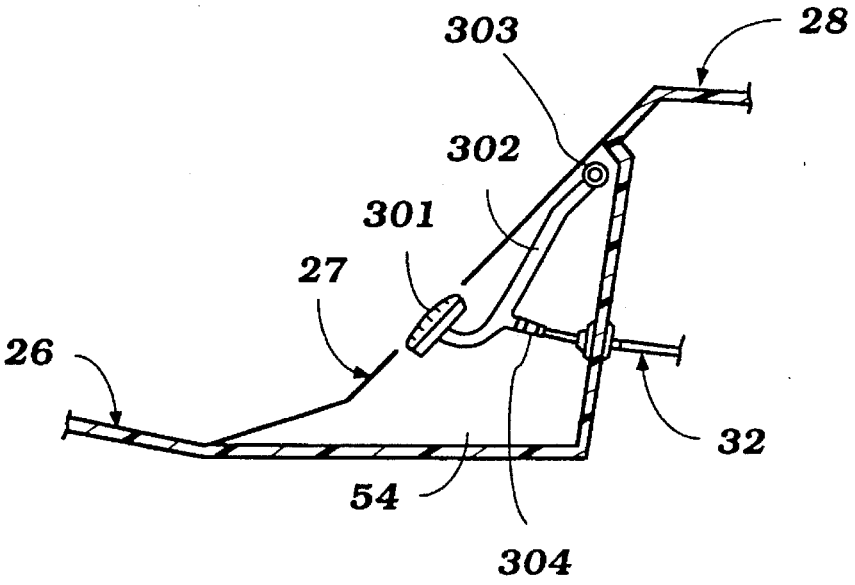
FIG. 7 is a cross-sectional view taken along the same plane as FIG. 6 and shows a fifth embodiment of the invention.
Figure 8:
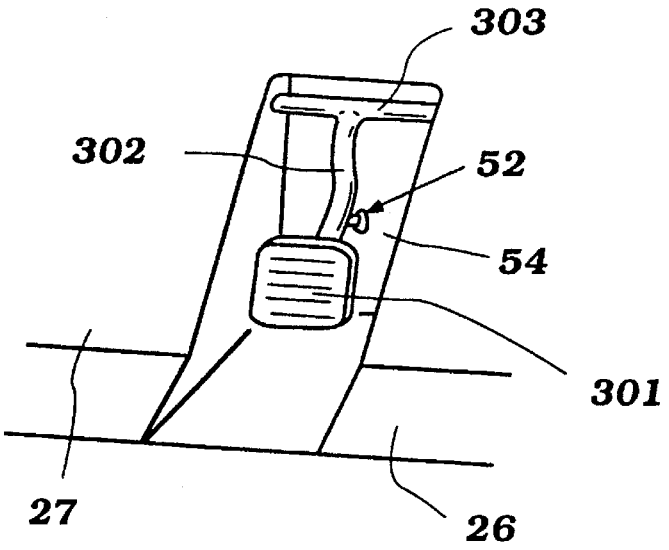
FIG. 8 is a perspective view of this embodiment looking at a slightly different angle from FIGS. 3–5.

FIGS. 7 and 8 show another embodiment which is generally the same as the embodiment of FIG. 6. In this embodiment, however, the pedal 301 is mounted at the lower end of a T-shaped pedal arm 302. The cross bar 303 of the pedal arm 302 is received on a pivot pin that spans the recessed area 54. The wire actuator 52 is connected to the vertical bar of the T-shaped pedal 302 by means of a connector 304. In this embodiment the recess is spaced outwardly of the raised position 17 and thus is completely surrounded by the toe board 27.

From the foregoing description, it should be readily apparent that the described reverse thrust bucket control pedal assemblies permits ease of operation of the reverse thrust bucket so that the operator may either adjust the trim or effect retardation or reverse thrust of the watercraft 11. This is accomplished without the necessity of having the pedal for actuating this mechanism extend above the floor area so that the rider's foot area is substantially free. However, the rider can easily operate the pedal if he desires. Of course, the foregoing description is that of preferred embodiments of the invention, and various changes and modifications may be made without departing from the spirit and scope of the invention, as defined by the appended claims.

We claim:

1. A watercraft propulsion control for a watercraft having a hull defining an operator's area in which an operator is seated and a floor area on which the operator may place at least one of his feet, said watercraft hull mounting a propulsion unit for propelling said hull and having at least one control element, said floor area being formed with a recessed portion disposed below a surrounding surface area, a pedal pivotally supported within said recessed portion, and an operative connection between said pedal and said control element for foot operation of said control element.

2. A watercraft propulsion control as set forth in claim 1, wherein the recessed area is bounded on one side by a raised portion of the hull at the termination of the floor area.

3. A watercraft propulsion control as set forth in claim 2, wherein a seat for accommodating a rider seated in straddle fashion is supported on the raised portion of the hull and at one side of the recessed portion.

4. A watercraft propulsion control as set forth in claim 3, wherein the recessed portion of the foot area is formed within an inclined toe board portion.

5. A watercraft propulsion control as set forth in claim 4, wherein the pedal is pivotally supported about a horizontal pivot axis disposed at the top of the recessed portion.

6. A watercraft propulsion control as set forth in claim 4, wherein the pedal is pivotally supported about a horizontally disposed axis at the lower end of the recessed portion.

7. A watercraft propulsion control as set forth in claim 4, wherein the pedal is pivotally supported about an inclined pivot axis disposed at one side of the recessed portion.

8. A watercraft propulsion control as set forth in claim 7, wherein the pedal pivot axis is disposed adjacent the raised portion.

9. A watercraft propulsion control as set forth in claim 1, wherein the control element is biased to a first position wherein the pedal surface is disposed substantially flush with and no higher than the surrounding surface of the foot area.

10. A watercraft propulsion control as set forth in claim 9, wherein the pedal is pivotally supported about a horizontal pivot axis disposed at the top of the recessed portion.

11. A watercraft propulsion control as set forth in claim 9, wherein the pedal is pivotally supported about a horizontally disposed axis at the lower end of the recessed portion.

12. A watercraft propulsion control as set forth in claim 9, wherein the pedal is pivotally supported about an inclined pivot axis disposed at one side of the recessed portion.

13. A watercraft propulsion control as set forth in claim 1, wherein the propulsion unit comprises a jet propulsion unit having a water inlet portion through which water is drawn, an impeller portion containing an impeller for pumping water, a discharge nozzle for discharging water in a rearward direction, and the control element comprises a reverse thrust bucket cooperating with the discharge nozzle of the jet propulsion unit for redirecting the flow of water therefrom for effecting trim and reverse thrust operations.

14. A watercraft propulsion control as set forth in claim 13, wherein the recessed portion is bounded on one side by a raised portion of the hull at the termination of the floor area.

15. A watercraft propulsion control as set forth in claim 14, wherein a seat for accommodating a rider seated in straddle fashion is supported on the raised portion of the hull and at one side of the recessed portion.

16. A watercraft propulsion control as set forth in claim 15, wherein the recessed portion of the foot area is formed within an incline toe board portion.

17. A watercraft propulsion control as set forth in claim 16, wherein the pedal is pivotally supported about a horizontal pivot axis disposed at the top of the recessed portion.

18. A watercraft propulsion control as set forth in claim 16, wherein the pedal is pivotally supported about a horizontally disposed axis at the lower end of the recessed portion.

19. A watercraft propulsion control as set forth in claim 16, wherein the pedal is pivotally supported about an inclined pivot axis disposed at one side of the recessed portion.

20. A watercraft propulsion control as set forth in claim 19, wherein the pedal pivot axis is disposed adjacent the raised portion.

* * * * *